United States Patent [19]

Schäfer

[11] Patent Number: 5,040,469

[45] Date of Patent: Ar . 20, 1991

[54] SHELF SYSTEM

[75] Inventor: Gerhard Schäfer, Neunkirchen-Salchendorf, Fed. Rep. of Germany

[73] Assignee: Fritz Schäfer Gesellschaft mit beschränkter Haftung, Neunkirchen, Fed. Rep. of Germany

[21] Appl. No.: 505,046

[22] Filed: Apr. 4, 1990

[30] Foreign Application Priority Data

Apr. 4, 1989 [DE] Fed. Rep. of Germany ... 8904109[U]

[51] Int. Cl.[5] ..... A47B 47/00

[52] U.S. Cl. ..... 108/110; 211/187; 108/111

[58] Field of Search ..... 108/107, 108, 109, 110, 108/111; 49/144, 148; 211/153, 187, 190

[56] References Cited

U.S. PATENT DOCUMENTS 969,822 9/1910 Wheeler ..... 108/109

4,732,358 3/1988 Hughes ..... 108/108

*Primary Examiner*—Kenneth J. Dorner

*Assistant Examiner*—Gerald A. Anderson

*Attorney, Agent, or Firm*—Toren, McGeady & Associates

[57] ABSTRACT

A shelf system includes at least four posts and shelf members suspended from hooks which are arranged in rows and are cut out from the sides of the posts and are bent into the interior of the shelf system. Above the hooks but within the structural height of the shelf members, projections are formed in the sides of the posts for filling out the gaps between the edges at the ends of the shelf members and the sides of the post. Tongues are provided above the projections. The lower ends of the tongues are in alignment with the upper surfaces of the shelf members. When the tongues are bent upwardly, they secure the shelf members against being lifted out.

3 Claims, 2 Drawing Sheets

SHELF SYSTEM

BACKGROUND OF THE INVENTION

1. Field of the Invention

The present invention relates to a shelf system composed of at least four posts and shelf members suspended between the four posts. The posts and the shelf members are of sheet metal. The shelf members are suspended from hooks which are arranged in rows and are cut out from the sides of the posts and are bent into the interior of the shelf system.

2. Description of the Related Art

It has been found that in shelf members which are suspended in the above-described manner, substantial disadvantages result from the use of shelf boxes or chests and when so-called cross-bracings are used for stabilizing the shelf system. For example, when the shelf boxes are pulled out forwardly and the next shelf members thereabove provide a support for the shelf boxes (so that the boxes project forwardly in the manner of inclined chest drawers), it is easily possible that the shelf members next above the shelf boxes are lifted out of their supports. This is always the case if the shelf members next above the shelf boxes do not support significant partial weights. If, on the other hand, cross-bracings are hooked into the shelf members and the shelf members are braced, particularly the lower shelf members are lifted out of their support. Accordingly, a bracing to the post is frequently utilized. However, this means that the posts are frequently pulled toward each other to such an extend that all shelf members are clamped in the shelf system and cannot be easily replaced.

SUMMARY OF THE INVENTION

It is the object of the present invention to provide a shelf system in which the above-described disadvantages of the known shelf systems are eliminated by simple means.

In accordance with the present invention, above the hooks but within the structural height of the shelf members, projections are formed in the sides of the posts, wherein the projections fill out the gaps between the edges at the ends of the shelf members and the sides of the posts. Tongues are arranged above the projections. The lower ends of the tongues are in alignment with the upper surfaces of the shelf members. When the tongues are bent upwardly, they secure the shelf members against being lifted out.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
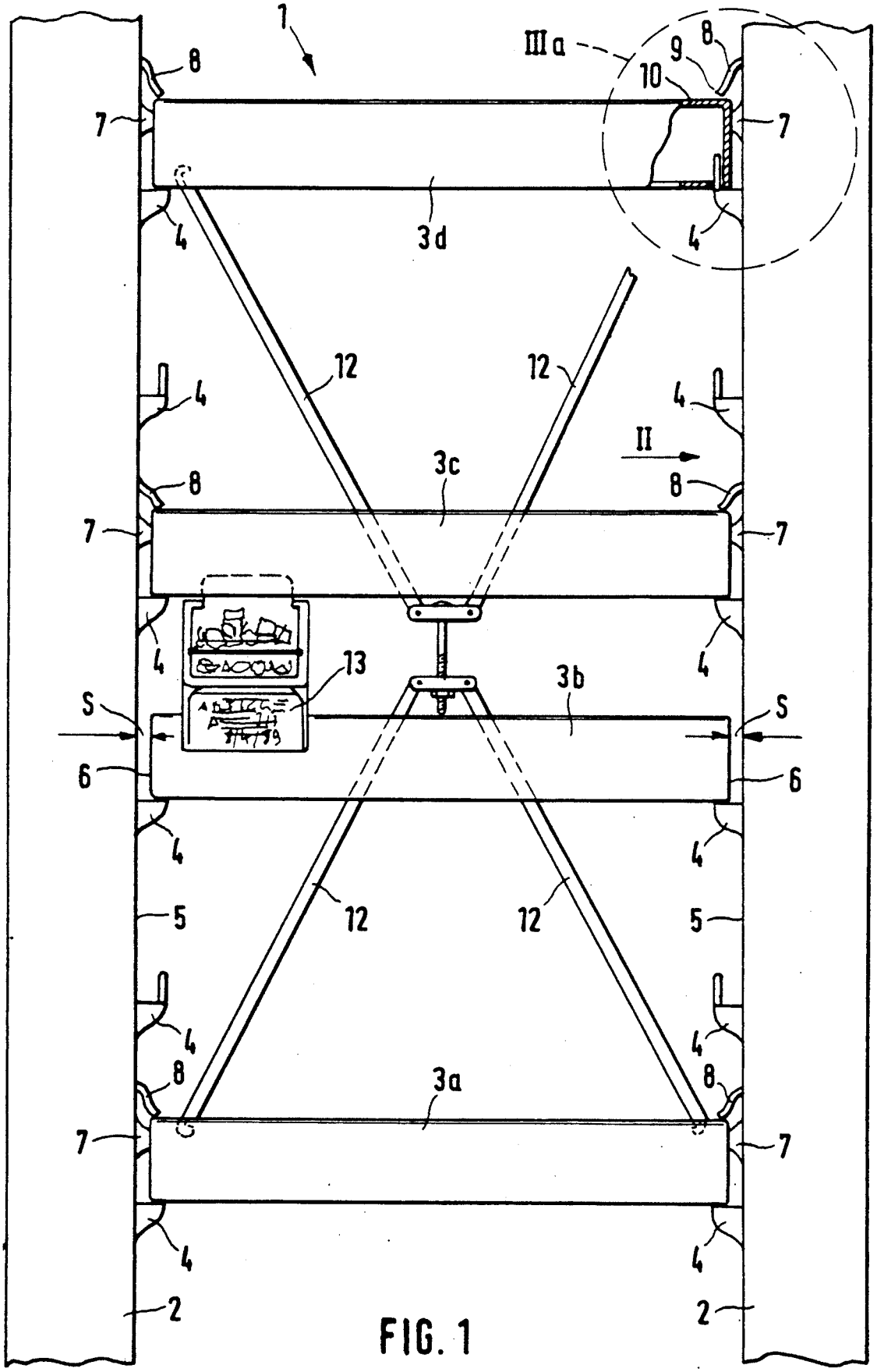
FIG. 1 is an elevational view of a shelf system with several shelf members.

The shelf system according to the present invention shown in the drawings is denoted by reference numeral 1. Shelf system 1 is composed of four posts 2 and the shelf members 3*a*, 3*b*, 3*c* and 3*d*. The shelf members are placed on hooks 4 which are cut from and bent out of the sides 5 of the posts 2. The shelf members do not extend over the entire inner width of the shelf system 1. Rather, as particularly illustrated in connection with shelf member 3*b*, a gap S remains on both sides between the rounded-off edges 6 of the shelf members 3 and the sides 5 of the posts 2. As shown in connection with shelf members 3*a*, 3*c* and 3*d*, the gaps S are closed or bridged by means of projections 7 which are formed out of sides 5 of the posts 2.

Figure 3:
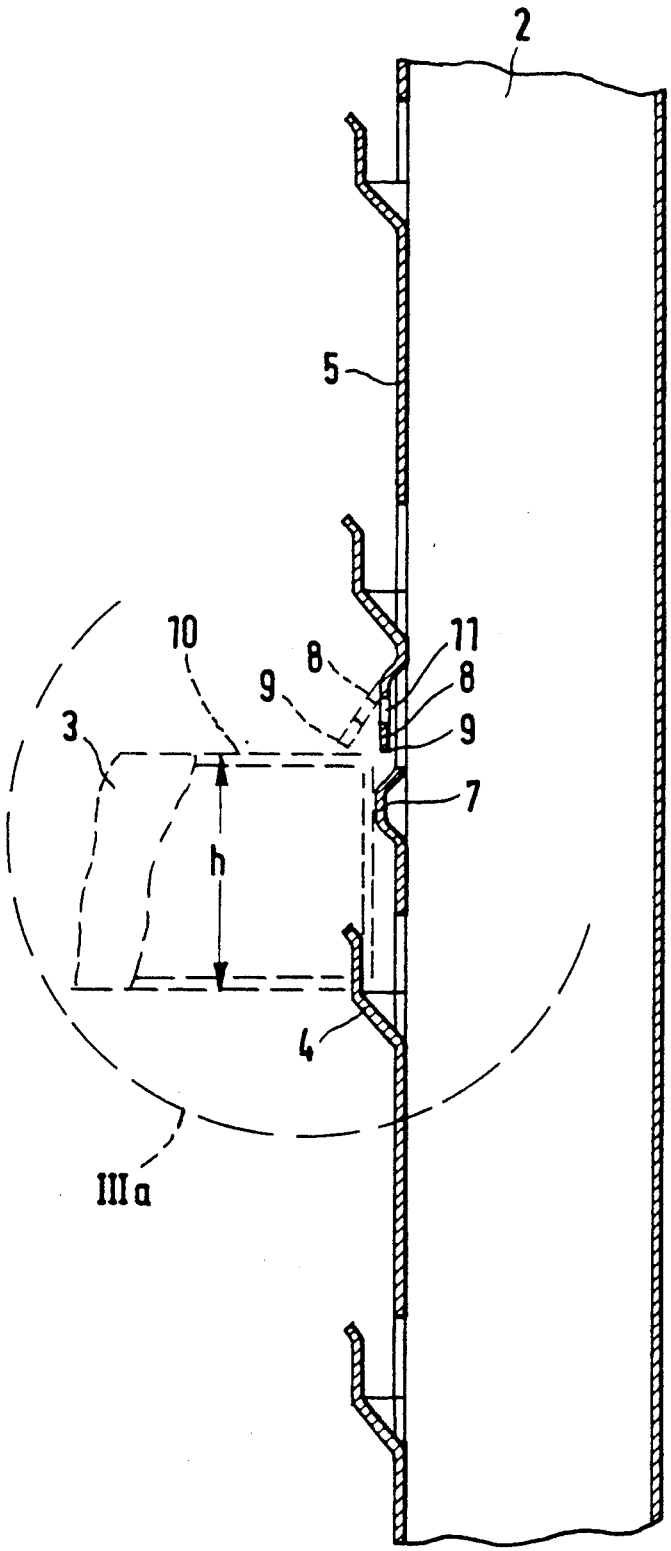
FIG. 3 is a sectional view of the post taken along sectional line III—III in FIG. 2 and shows, on a larger scale, the detail indicated by circle III*a* in FIG. 1.

As particularly shown in FIG. 3, tongues 8 are arranged above each projection 7. The lower ends 9 of the tongues 8 are in alignment with the upper surfaces 10 of the shelf members 3. Accordingly, when the tongues 8 are bent upwardly, the tongues 8 can block the shelf members 3.

Figure 2:
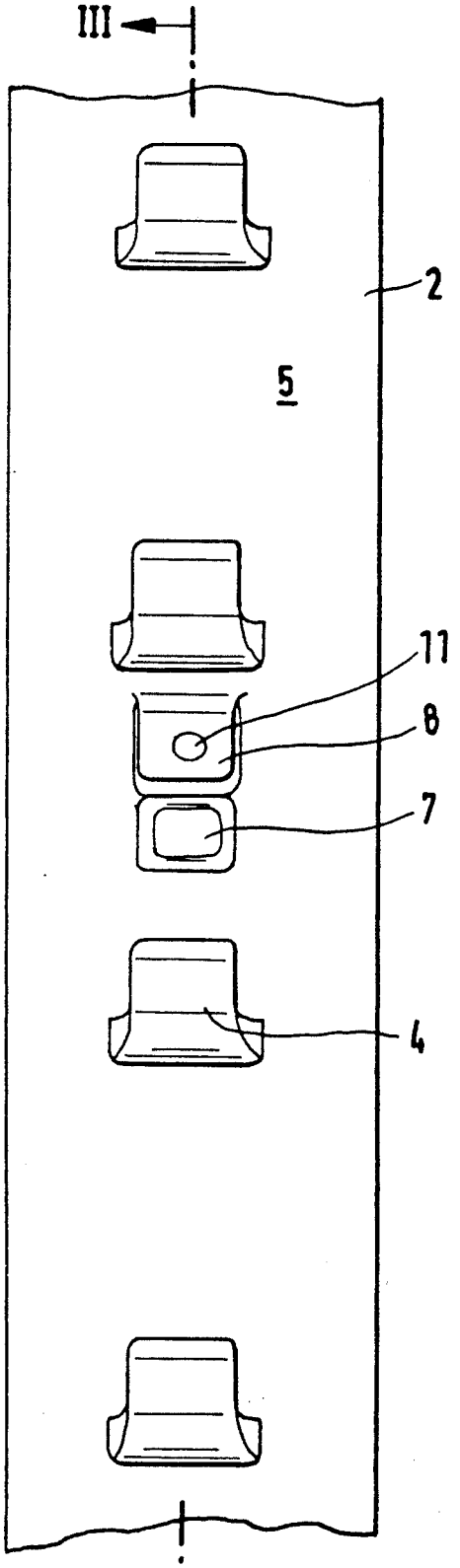
FIG. 2 is a view of the inner side of a post in the direction of arrow II in FIG. 1.

As illustrated in FIG. 2, the tongues 8 have openings 11 for the insertion of, for example, nails used for bending the tongues 8 upwardly. As a result, the shelf members 3*a*, 3*c* and 3*d* of the shelf system 1 shown in FIG. 1 are blocked, so that it is possible to mount a cross-bracing 12 between the shelf members 3*a* and 3*d* without causing the lowermost shelf member 3*a* to be raised. The shelf member 3*c* is also not raised if, as shown in the drawing, a shelf box 13 is pulled out toward the front into a tilted position.

It is apparent that, independently of the cross-bracings, the manner of securing the shelf members described above provides an additional strength to the shelf system, particularly since the shelf members can now be considered structural shelf members.

While a specific embodiment of the invention has been shown and described in detail to illustrate the application of the inventive principles, it will be understood that the invention may be embodied otherwise without departing from such principles.

What is claimed is:

1. In a shelf system having at least four posts and shelf members suspended between the posts, the posts and the shelf members being of sheet metal, the posts having sides and the shelf system having an interior between the sides, the shelf members having ends, gaps being defined between the shelf members and the sides of the posts, the shelf members having upper surfaces, hooks arranged in rows being cut out from the sides of the posts and being bent into the interior of the shelf system, the improvement comprising non-deformable projections being formed by pressing out areas of the sides of the posts, the projections being located above the hooks and below the upper surfaces of the shelf members, the projections being dimensioned to fill out the gaps between the ends of the shelf members and the sides of the posts, non-resilient tongues having lower ends being arranged above the projections, the tongues being formed from the sides of the posts by cutting and bending the tongues outwardly and upwardly from the sides of the posts, the lower ends of the tongues being in alignment with the upper surfaces of the shelf members, so that the tongues secure the shelf members against being lifted out.

2. The shelf system according to claim 1, wherein openings are defined in the tongues for receiving means for bending the tongues.

3. The shelf system according to claim 2, wherein the bending means are pins or nails.

* * * * *